United States Patent [19]

Conlon

[11] Patent Number: 4,551,373

[45] Date of Patent: Nov. 5, 1985

[54] LABEL CONSTRUCTION

[76] Inventor: Thomas J. Conlon, 90 Broadway, Massapequa Park, N.Y. 11762

[21] Appl. No.: 548,788

[22] Filed: Nov. 4, 1983

[51] Int. Cl.[4] ..... G09F 3/00

[52] U.S. Cl. ..... 428/43; 40/2 R; 40/306; 283/81; 283/105; 283/106; 428/121; 428/916

[58] Field of Search ..... 40/2 G, 2 R, 594, 306; 283/81, 105, 106; 428/43, 121, 916

[56] References Cited

U.S. PATENT DOCUMENTS

| | | | |
|---|---|---|---|
| Re. 14,000 | 10/1915 | Cole | 428/43 X |
| 1,896,834 | 2/1933 | Brown | 40/306 |
| 2,093,985 | 9/1937 | Stansbury | 40/2 R X |
| 2,127,081 | 8/1938 | Brown | 40/306 |
| 2,131,448 | 9/1938 | Lowen | 40/594 |
| 2,420,045 | 5/1947 | Krug | 40/2 R X |
| 2,706,865 | 4/1955 | Miller | 40/306 |
| 3,315,386 | 4/1967 | Kest et al. | 40/594 X |
| 3,524,271 | 8/1970 | Buske | 40/2 R |
| 3,702,511 | 11/1972 | Miller | 40/2 G X |
| 4,099,721 | 7/1978 | Logander | 273/139 |
| 4,278,199 | 7/1981 | Tanaka | 283/1 B X |
| 4,323,608 | 4/1982 | Denny et al. | 428/43 |
| 4,324,823 | 4/1982 | Ray, III | 428/43 |

FOREIGN PATENT DOCUMENTS 506116 2/1953 Belgium .

*Primary Examiner*—Henry F. Epstein
*Attorney, Agent, or Firm*—Robert E. Isner

[57] ABSTRACT

Label construction incorporating a hidden, but purchaser accessible retail gamepiece. Such label includes a main body portion, an end portion foldable into overlying relation over a porton of the main body portion covering a retail gamepiece and forming a coplanar exposed surface that serves as a continuation of the exposed surface of the main body portion.

4 Claims, 4 Drawing Figures

LABEL CONSTRUCTION

This application relates to consumer product package labels and, more particularly, to an improved label construction for consumer product packages that incorporates a concealed retail game element therein that is readily accessible to a purchaser at the point of sale.

The retailing of consumer products, as for example food products, household cleaning products, beverages and the like, is highly competitive and particularly so at the retail or point of sale level. Most of such consumer products are purveyed in cans, boxes, bottles, packets and like containers that incorporate, or which may readily incorporate, distinctive printed labels that conventionally and distinctively identify the nature and source of the product contained therein. Such labels are usually adhesively secured to the product container. Perhaps the most familiar and common examples thereof are the wraparound type of label conventionally found on canned goods and the paste-on labels conventionally employed on bottled beverages and which usually overlie only a portion of the available container surface. Still another common example are the printed surface containers that can support an overlying label element or other promotional adJunct on a portion of the surface thereof.

Due to ever growing competitive pressures, recent years have witnessed a host of promotional concepts directed to the retail sales level to induce a purchaser to select a particular product. One of the common promotional concepts so employed is the "retail game" device, wherein the purchaser of a product is given a game card or other gamepiece at the time of purchase that offers a hope of a large return, often in a sweepstakes context. One of the most popular of such retail game devices is the "Instant Winner" type, wherein the recipient of the gamepiece can immediately determine whether she or he is a winner or not. Such winners can be rewarded at the point of sale location or can receive their winning prize only after a return of the winning gamepiece to a redemption location. One of the recognized disadvantages of such retail game concepts is the fact that the product and the game card or gamepiece are physically separate entities and normally only come together at the time of actual purchase, as by a supermarket cashier handing the purchaser the gamepiece at the time of purchase at a checkout counter. Such physical separation of the product and the gamepiece not only creates opportunities for extensive abuse through intermediate handling of the gamepiece, but effectively removes control of the particular promotion from the producer of the product. While such disadvantages can be avoided by inclusion of the gamepiece within the product container, the added complication of packaging and purchaser access thereto, to say nothing of product contamination, have rendered such approach commercially impractical.

This invention may be briefly described as an improved consumer product label construction that incorporates a hidden, but purchaser accessible, retail gamepiece in effectively tamperproof form. In its broader aspects, the invention includes a label element having a main body portion adapted to be adhesively secured to a product container, and an end portion that is foldable into overlying relation with a portion of the surface of the main body portion to form a composite and essentially coplanar exposed surface adapted to contain the distinctive product and source indicia thereon, and wherein the covered area of the label body portion includes a retail gamepiece that is exposable only by removal of at least a portion of the overlying foldable end portion by the purchaser of the product. In its narrower aspects, the subject invention further includes the provision of a gamepiece that is separably removable from the main body portion of the label following its exposure thereon.

Among the advantages of the subject invention is the provision of an improved consumer product label construction that incorporates a hidden retail gamepiece in effectively tamperproof condition and which is readily accessible to a purchaser of the product. Still other advantages include the permitted maintenance of retail game device control by the product manufacturer, the direct physical coupling of the retail gamepiece with a particular product package, and a marked reduction in opportunities for abuse of the retail gamepiece promotional concepts.

Further obJects and advantages of the subject invention will become apparent from the following portions of this specification and from the appended drawings which illustrate, in accord with the mandate of the patent statutes, a presently preferred embodiment of a consumer product label construction incorporating the principles of this invention.

Referring to the drawings.

Figure 1:
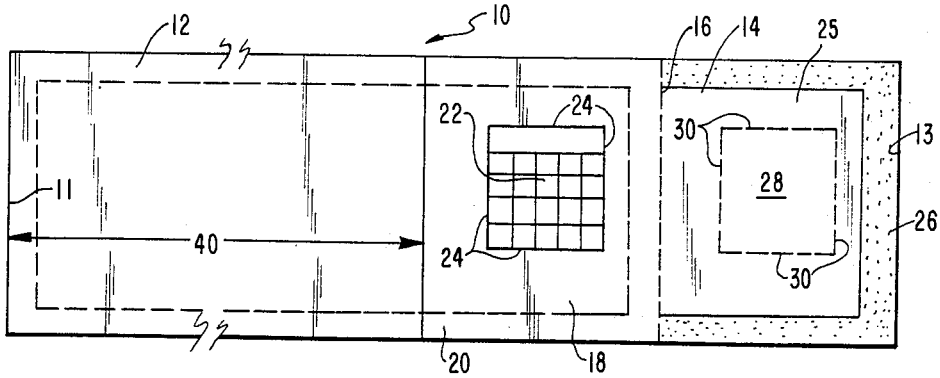
FIG. 1 is a plan view of an improved label construction incorporating the principles of this invention and shown in flat unfolded condition.

Referring to the drawings and initially to FIG. 1, there is provided a planar label element generally designated 10 and formed of suitable material such as paper. Such label 10 may conventionally, although not necessarily, be of rectangular configuration. The label element 10 includes a main body portion 12 extending from one marginal edge 11 to a fold line 16 and an end portion 14 disposed intermediate such fold line 16 and a second marginal edge 13. As is apparent from the drawings, the end portion 14 is foldable about fold line 16, into overlying relation on top of an equivalently sized portion 18 of the upper surface of the main body portion 12. Disposed on the rear or underside of the body portion 12 of the label is appropriate means for adhesively securing said main body portion 12 to the product package and suitably comprising adhesive material disposed at least adjacent the perimetric edge portions of said rear surface thereof, as shown by the dotted lines 20. Such adhesive means, however, does not extend to the undersurface of the foldable end portion 14 since the undersurface thereof will become the upper or exposed surface thereof after the folding thereof has taken place.

Disposed within the portion 18 of the upper surface of the label body portion 12 adapted to underlie the folded-over end portion 14 is a retail gamepiece 22. Such gamepiece can be of any desired format and by way of illustrative example, could suitably be of the "scrapeoff" type of gamepiece. Preferably said gamepiece 22 could be bounded by perimetric score lines 24 to facilitate its separation and removal from the main label body portion 12. The upper surface 25 of the foldable end portion 14 (as shown in unfolded condition in FIG. 1) includes suitable adhesive means for securing said surface into folded interfacial relation with the upper surface portion 18 of the main body portion 12, suitably by incorporation of adhesive means 26 disposed adjacent the perimetric edge portions thereof. The foldable end portion 14 also desirably includes, in the illustrated preferred embodiment, a removable cover segment 28, defined by score lines 30, sized and positioned to overlay and cover the gamepiece 22 when the end portion 14 is disposed in folded-over condition.

Figure 2:
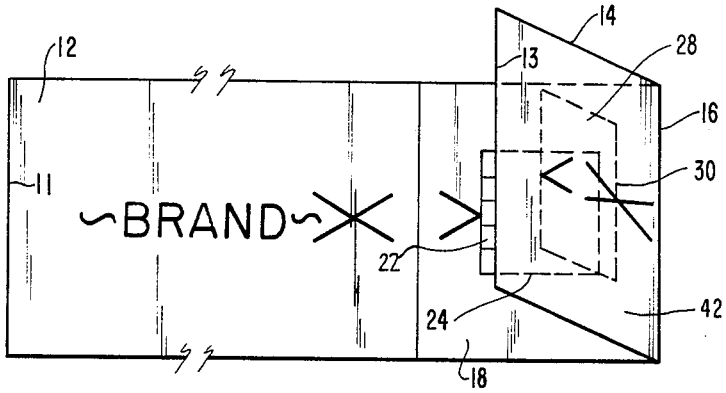
FIG. 2 is a plan view of the label of FIG. 1, with the end portion thereof being disposed in partially folded-over condition.
Figure 3:
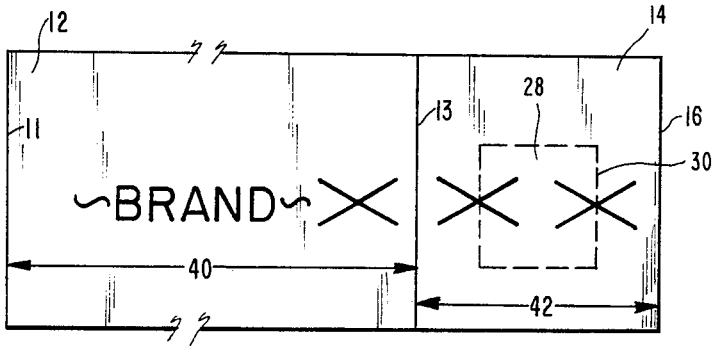
FIG. 3 is a plan view of the label of FIG. 1 in fully folded condition.

FIG. 2 illustrates the label construction of FIG. 1 with the foldable end portion 14 disposed in partially folded-over relation with the main body portion 12. FIG. 3 illustrates the label of FIG. 2 with the foldable end portion 14 disposed in folded overlying and adhesively secured relation to the main body portion 12 and wherein the cover element 28 is disposed in overlying but adhesively unsecured relation with the gamepiece 22.

As will be apparent from FIG. 3, the distinctive product and source identification indicia on the label surface is imprinted on the ever exposed upper surface 40 of the main body portion 12 and also on the rear surface 42 of the end portion 14, in such manner as to compositely form a continuity of exposed label surface having the distinctive source and product indicia thereon in unbroken and uninterrupted form.

Figure 4:
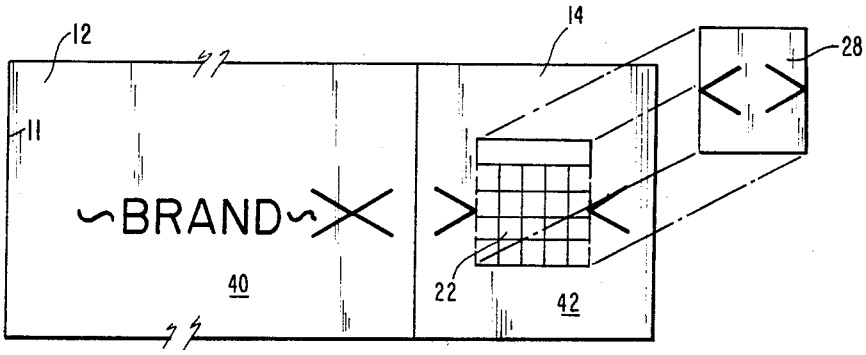
FIG. 4 is a plan view of the label of FIG. 3 following separation and removal of a portion of the folded-over end element to expose the retail gamepiece incorporated therein.

FIG. 4 illustrates the ready accessibility of the gamepiece 22 as effected by separation of the cover segment 28 through severance at the score lines 30. As noted above, the gamepiece 22 is also desirably removable from the main body portion 12 of the label by severance at the score lines 24.

In the fabrication of the described label, the base label element as depicted in FIG. 1 will have its ever exposed surface portion 40 of the main body portion 12 and the rear surface 42 of the foldable end portion 14 preprinted in such manner as to form a continuous pattern of the distinctive product and source indicia when the end portion 14 is ultimately folded over and secured to main body portion 12 thereof. Such printing may also include the gamepiece 22 delineation on the surface portion 18.

In a similar manner, the necessary adhesive coating 20 will be placed upon the rear or undersurface of the main body 12 and upon the upper surface of the foldable end portion 14, as at 26, at the initial stage of fabrication. When the label 10 has been so prepared, the end portion 14 will be folded over the main body portion 12, as indicated in FIG. 2, to assume the configuration shown in FIG. 3, at which time the gamepiece 22 will be covered and the surfaces 30 and 42 will compositely present the desired distinctive product source identification to the purchaser. Such label may then be secured to the product package for shipment to retail sale locations.

As will now be apparent, the foregoing label is effectively tamperproof once it is secured to the product package in that any attempt to gain access to the gamepiece 22 will necessarily result in a destruction of label integrity.

Potential abuse of the described label constructions in a point of sale promotional concept can be further reduced by including an individual serial number on both the covered surface 18 and upon the removable gamepiece 22. If someone other than a purchaser of the product removes the cover segment 26 and the gamepiece 22 without purchasing the product, a crosscheck can be made at the point of sale or, if a mail-in type of game device is employed, by a check of submitted gamepieces with unsold and redeemed product serial numbers.

As will be apparent to those skilled in this art, the foldable end portion 14, as preferably interconnected to the main body portion 12 by the illustrated fold line 16, could also be connected to the main body portion 12 by a fold line that is located at the end of the upper or lower defining edges of said body portion. When so disposed, the portion could be folded upwardly or downwardly into overlying relation with the covered portion 18 bearing the gamepiece 22.

Having thus described my invention, I claim:

1. An improved label construction for a retail product comprising a base label segment including a main body portion securable to said product, and an end portion foldably disposable into overlying coplanar relationship with a portion of the upper surface of said main body portion said end portion having a first surface adapted to be disposed in interfacial overlying abutting relation with the portion of the upper surface of said body portion disposed therebeneath when disposed in folded-over condition, and a second surface adapted to form a coplanar continuation of the upper surface of said body portion when said end portion is disposed in folded condition thereover, said foldable end portion serving to define, when folded into overlying coplanar relation with said main body portion, an ever exposed upper surface on said main body portion and an adjacent concealable upper surface on said main body portion disposed therebeneath, means disposed at least adjacent a portion of the perimetric edge of the first surface of said end portion to secure the end portion in overlying relation with the concealable upper surface of said main body portion when folded thereover, product identification indicia complementally disposed on the ever exposed surface of said main body portion and on the second surface of said foldable end portion to compositely present the same in continuous unbroken relation when said end portion is folded over said main body portion; and means for facilitating removal of at least a portion of said end portion from overlying relationship with said concealable upper surface of said body portion to expose the surface of the main body portion therebeneath.

2. An improved label construction for adhesive securement to a product container surface, comprising a base label segment including a main body portion having first adhesive means disposed on at least a portion of the rear surface thereof for adhesive securement to said product container surface, and an end portion foldably disposable into overlying coplanar relationship with a portion of the upper surface of said main body portion said end portion having a first surface adapted to be disposed in interfacial overlying abutting relation with the portion of the upper surface of said body portion disposed therebeneath when disposed in folded-over condition, and a second surface adapted to form a coplanar continuation of the upper surface of said body portion when said end portion is disposed in folded condition thereover, said foldable end portion serving to define, when folded into overlying coplanar relation with said main body portion, an ever exposed upper surface on said main body portion and an adjacent concealable upper surface on said main body portion disposed therebeneath, second adhesive means disposed at least adjacent a portion of the perimetric edge of the first surface of said end portion to adhesively secure the end portion in overlying relation with the concealable upper surface of said main body portion, when folded thereover, product identification indicia complementally disposed on the ever exposed surface of said main body portion and on the second surface of said foldable end portion to compositely present the same in continuous unbroken relation when said end portion is folded over said main body portion.

retail gamepiece means disposed on the concealable upper surface of said body portion, and means for facilitating removal of at least a portion of said end portion from overlying relationship with said concealable upper surface of said body portion to expose said retail gamepiece means disposed therebeneath.

3. The label construction as set forth in claim 2 wherein said retail gamepiece means is separable from said main body portion of said label.

4. The label construction as set forth in claim 3 wherein said end portion includes a readily separable cover element adapted to be disposed in aligned overlying relationship with said retail gamepiece means to permit exposure of the latter.

* * * * *